US012163202B2

(12) United States Patent
Obata et al.

(10) Patent No.: US 12,163,202 B2
(45) **Date of Patent: *Dec. 10, 2024**

(54) HOT PRESS MEMBER, PRODUCTION METHOD FOR STEEL SHEET FOR HOT PRESS, AND PRODUCTION METHOD FOR HOT PRESS MEMBER

(71) Applicant: JFE STEEL CORPORATION, Tokyo (JP)

(72) Inventors: Yoshie Obata, Tokyo (JP); Katsutoshi Takashima, Tokyo (JP); Minoru Tanaka, Tokyo (JP); Yoshiko Nakahara, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 611 days.

This patent is subject to a terminal disclaimer.

(21) Appl. No.: 17/437,357

(22) PCT Filed: Feb. 13, 2020

(86) PCT No.: PCT/JP2020/005585

§ 371 (c)(1),
(2) Date: Sep. 8, 2021

(87) PCT Pub. No.: WO2020/184055

PCT Pub. Date: Sep. 17, 2020

(65) Prior Publication Data

US 2022/0177992 A1 Jun. 9, 2022

(30) Foreign Application Priority Data

Mar. 12, 2019 (JP) ..... 2019-045042

(51) Int. Cl.

| | |
|---|---|
| ***C21D 9/46*** | (2006.01) |
| ***B21C 47/02*** | (2006.01) |
| ***B21D 22/02*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(Continued)

(52) U.S. Cl.

CPC ..... *C21D 9/46* (2013.01); *B21C 47/02* (2013.01); *B21D 22/022* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/60* (2013.01); *C23C 2/02* (2013.01); *C23C 2/0224* (2022.08); *C23C 2/024* (2022.08); *C23C 2/06* (2013.01); *C23C 2/12* (2013.01); *C23C 2/28* (2013.01); *C23C 2/40* (2013.01); *C23G 1/00* (2013.01); *C21D 2211/001* (2013.01); *C21D 2211/008* (2013.01)

(58) Field of Classification Search

CPC ..... C21D 9/46; C21D 8/0226; C21D 8/0236; C21D 8/0273; C21D 1/18; C21D 1/28; C21D 8/0278; C21D 8/0426; C21D 8/0436; C21D 8/0473; C21D 8/0478; C21D 9/00; C21D 2211/008; B21D 22/022; C22C 38/001; C22C 38/02; C22C 38/04; C22C 38/06; C22C 38/00; C22C 38/42; C22C 38/44; C22C 38/46; C22C 38/58; C23G 1/081; C23G 1/085; C23G 1/088; C23G 1/02; C23G 1/00; C23C 2/02; C23C 2/0224; C23C 2/024; C23C 2/06; C23C 2/12; C23C 2/28; C23C 2/40

USPC ..... 148/533

See application file for complete search history.

(56) References Cited

U.S. PATENT DOCUMENTS 11,293,074 B2 * 4/2022 Takashima ..... C21D 6/008
11,850,821 B2 * 12/2023 Takashima ..... C21D 6/008

(Continued)

FOREIGN PATENT DOCUMENTS

CN 102939399 A 2/2013
EP 3 178 955 A1 6/2017

(Continued)

OTHER PUBLICATIONS

Aug. 11, 2022 Office Action Issued in Chinese Patent Application No. 202080019933.9.

(Continued)

*Primary Examiner* — Brian D Walck
*Assistant Examiner* — Danielle Carda
(74) *Attorney, Agent, or Firm* — Oliff PLC

(57) ABSTRACT

A hot press member includes excellent indentation peel strength which has a tensile strength of 1780 MPa or more. A plating layer has at a surface thereof a 10-point average roughness Rzjis of 25 μm or less, and a steel sheet contains, in mass %, not less than 0.25% but less than 0.50% of C, 1.5% or less of Si, 1.1-2.4% of Mn, 0.05% or less of P, 0.005% or less of S, 0.01-0.50% of Al, 0.010% or less of N, 0.001-0.020% of Sb, 0.005-0.15% of Nb, and 0.005-0.15% of Ti, the balance being Fe and incidental impurities. The average crystal grain size of prior austenite is 7 μm or less and the volume proportion of martensite is 90% or more, within 50 μm in the thickness direction from the surface of the steel sheet excluding the plating layer.

10 Claims, No Drawings

(51) Int. Cl.

| | |
|---|---|
| ***C22C 38/60*** | (2006.01) |
| ***C23C 2/02*** | (2006.01) |
| ***C23C 2/06*** | (2006.01) |
| ***C23C 2/12*** | (2006.01) |
| ***C23C 2/28*** | (2006.01) |
| ***C23C 2/40*** | (2006.01) |
| ***C23G 1/00*** | (2006.01) |

(56) References Cited

U.S. PATENT DOCUMENTS

| | | | | |
|---|---|---|---|---|
| 2012/0216925 | A1* | 8/2012 | Kobayashi | C22C 38/02 148/330 |
| 2013/0095347 | A1 | 4/2013 | Kawasaki et al. | |
| 2016/0319403 | A1 | 11/2016 | Asai et al. | |
| 2017/0044640 | A1* | 2/2017 | Kimura | C23C 2/06 |
| 2017/0211164 | A1 | 7/2017 | Kimura et al. | |
| 2018/0002790 | A1 | 1/2018 | Kim et al. | |
| 2018/0010207 | A1 | 1/2018 | Futamura et al. | |
| 2020/0095660 | A1 | 3/2020 | Asai et al. | |
| 2020/0131597 | A1 | 4/2020 | Takashima et al. | |
| 2020/0172991 | A1 | 6/2020 | Takashima et al. | |
| 2020/0354806 | A1 | 11/2020 | Takashima et al. | |
| 2020/0370140 | A1* | 11/2020 | Takashima et al. | C21D 9/46 |
| 2022/0186339 | A1* | 6/2022 | Takashima | C21D 8/0463 |

FOREIGN PATENT DOCUMENTS

| | | | | |
|---|---|---|---|---|
| EP | 3 178 956 | A1 | 6/2017 | |
| EP | 3 178 957 | A1 | 6/2017 | |
| JP | 2003-328099 | A | 11/2003 | |
| JP | 2006-077329 | A | 3/2006 | |
| JP | 2011-063877 | A | 3/2011 | |
| JP | 2012-126943 | A | 7/2012 | |
| JP | 2012-157900 | A | 8/2012 | |
| JP | 2015-143392 | A | 8/2015 | |
| JP | 2016-130358 | A | 7/2016 | |
| JP | 2017-043825 | A | 3/2017 | |
| JP | 2017-140633 | A | 8/2017 | |
| JP | 2017-179588 | A | 10/2017 | |
| KR | 2016-0077567 | A | 7/2016 | |
| KR | 10-2018-0074009 | A | 7/2018 | |
| WO | 2015/162849 | A1 | 10/2015 | |
| WO | 2016/013145 | A1 | 1/2016 | |
| WO | 2019/003538 | A1 | 1/2019 | |
| WO | 2019/003540 | A1 | 1/2019 | |
| WO | 2019/003541 | A1 | 1/2019 | |
| WO | WO2019003542 | A1 * | 1/2019 | C21D 1/18 |

OTHER PUBLICATIONS

May 18, 2021 Office Action issued in Japanese Patent Application No. 2020-530393.

May 12, 2020 Search Report issued in International Patent Application No. PCT/JP2020/005585.

Sep. 14, 2021 Office Action issued in Japanese Patent Application No. 2020-530393.

Mar. 9, 2023 Office action and Search Report issued in Chinese Patent Application No. 202080019933.9.

Q. Miaogen; Handbook of Material Surface Technology and Its Applications; 1998; pp. 106-109.

Jan. 4, 2022 Extended Search Report issued in European Patent Application No. 20770209.3.

Jul. 27, 2023 Office Action issued in Korean Patent Application No. 10-2021-7028939.

Dec. 13, 2022 Office Action Issued in Korean Patent Application No. 10-2021-7028939.

Jun. 18, 2024 Trial Decision on Appeal issued in Korean Patent Application No. 2021-7028939.

Barlow, D. "Pickling Steel", American Galvanizers Association, 2015, https://galvanizeit. org/knowledgebase/article/pickling-steel.

* cited by examiner

HOT PRESS MEMBER, PRODUCTION METHOD FOR STEEL SHEET FOR HOT PRESS, AND PRODUCTION METHOD FOR HOT PRESS MEMBER

TECHNICAL FIELD

The present invention relates to a hot pressed member, a method of producing a steel sheet for hot pressing and a method of producing a hot pressed member.

BACKGROUND ART

In recent years, environmental issues are rising, and $CO_2$ emission regulations have been tightened. In the automotive field, it is challenged to reduce the vehicle body weight for an improvement in the fuel efficiency. Accordingly, it has been encouraged to thin the automotive parts through the use of high strength steel sheets, and application of steel sheets having a tensile strength (TS) of not less than 1,780 MPa has been studied.

Steel sheets having a tensile strength of not less than 1,780 MPa may, however, experience cracking during cold press forming or experience large spring-back due to high yield strength, thereby failing to be formed with high dimension accuracy in some cases.

Hence, formation by hot pressing (also referred to as hot stamping, die quenching, press quenching or the like) has recently drawn attentions. Hot pressing is a technique which involves heating a steel sheet to a temperature range of austenite single phase and subsequently forming (processing) the steel sheet with high temperature being maintained. With this technique, a steel sheet can be formed with high dimension accuracy. In addition, the steel sheet can be strengthened by hardening the steel sheet through cooling after formation.

In the meantime, resistance spot welding is often performed in automotive assembly.

At some sites where a resistance spot welding gun cannot reach, however, bolt fastening is adopted, and in that case, projection welding is performed (see Patent Literatures 1 and 2). Specifically, a nut having a projection is first resistance welded to a steel sheet. As a result, a weld joint (projection welded portion) between the projection of the nut and the steel sheet is formed. Thereafter, another steel sheet is assembled to the steel sheet using a bolt.

CITATION LIST

Patent Literature

Patent Literature 1: JP 2012-126943 A
Patent Literature 2: JP 2012-157900 A

SUMMARY OF INVENTION

Technical Problems

With a chemical composition ensuring a tensile strength of not less than 1,780 MPa, a steel sheet has high deformation resistance. In addition, hot pressing causes an alloying reaction in a plating layer, thereby leading to large surface roughness. Accordingly, there may be a problem that in a steel sheet having been hot pressed (hot pressed member), indentation peeling strength at a projection welded portion (hereinafter, referred to as "indentation peeling strength after projection welding" or simply "indentation peeling strength") is insufficient.

The present invention has been made in view of the foregoing, and an object of the present invention is to provide a hot pressed member having excellent indentation peeling strength.

Another object of the present invention is to provide a method of producing a steel sheet for hot pressing and a method of producing a hot pressed member using a steel sheet for hot pressing produced by the foregoing method.

Solution to Problems

The present inventors found, through an earnest study, that employing the configuration described below enables the achievement of the above-mentioned objectives, and the invention has been completed.

Specifically, the present invention provides the following [1] to [5].

[1] A hot pressed member including a steel sheet and a plating layer on a surface of the steel sheet, wherein the hot pressed member has a tensile strength of not less than 1,780 MPa, wherein ten point height of irregularities Rzjis of a surface of the plating layer is not more than 25 μm, and wherein the steel sheet has a chemical composition containing, by mass %, C: not less than 0.25% and less than 0.50%, Si: not more than 1.5%, Mn: not less than 1.1% and not more than 2.4%, P: not more than 0.05%, S: not more than 0.005%, Al: not less than 0.01% and not more than 0.50%, N: not more than 0.010%, Sb: not less than 0.001% and not more than 0.020%, Nb: not less than 0.005% and not more than 0.15%, and Ti: not less than 0.005% and not more than 0.15%, with the balance being Fe and inevitable impurities, and wherein the steel sheet has, in a region within 50 μm in a sheet thickness direction from a surface of the steel sheet excluding the plating layer, a microstructure in which prior austenite has an average grain size of not more than 7 μm, and a volume fraction of martensite is not less than 90%.

[2] The hot pressed member according to [1] above, wherein the chemical composition of the steel sheet further contains at least one selected from the group consisting of, by mass %, B: not more than 0.0050%, Mo: not more than 0.50%, Cr: not more than 0.50%, Ca: not more than 0.005%, Mg: not more than 0.005%, REM: not more than 0.005%, V: not more than 0.15%, Cu: not more than 0.50%, Ni: not more than 0.50%, Sn: not more than 0.50%, Zn: not more than 0.10%, and Ta: not more than 0.10%.

[3] The hot pressed member according to [1] or [2] above, wherein the plating layer is a Zn-based plating layer, a Zn—Ni-based plating layer or an Al-based plating layer.

[4] A method of producing a steel sheet for hot pressing, the method comprising: heating a steel material having the chemical composition described in claim [1] or [2] at temperature of not lower than 1,100° C. and not higher than 1,250° C. for not less than 30 minutes and not more than 120 minutes; hot rolling the steel material having undergone the heating at finish rolling temperature of not lower than 860° C. and not higher than 950° C. to obtain a hot rolled steel sheet; coiling the hot rolled steel sheet at coiling temperature of not higher than 500° C.; pickling the hot rolled steel sheet having undergone the coiling using an acid liquid at temperature of not lower than 20° C. and not higher than 70° C. for not less than 10 seconds and not more than 100 seconds; cold rolling the hot rolled steel sheet having undergone the pickling to obtain a cold rolled steel sheet; subjecting the cold rolled steel sheet to annealing comprising a first annealing and a second annealing; and plating the cold rolled steel sheet having undergone the annealing, whereby the steel sheet for hot pressing is obtained, where in the first annealing, the cold rolled steel sheet is retained at temperature of not lower than 850° C. and not higher than 950° C. for not more than 600 seconds, subsequently cooled to cooling stop temperature of not lower than 350° C. and not higher than 450° C., retained at the cooling stop temperature for not less than 60 seconds and not more than 1,800 seconds, and thereafter cooled to room temperature, and in the second annealing, the cold rolled steel sheet having been subjected to the first annealing is retained at temperature of not lower than 720° C. and not higher than 850° C. for not less than 15 seconds, and subsequently cooled to cooling stop temperature of not higher than 600° C. at an average cooling rate of not lower than 5° C./s.

[5] A method of producing a hot pressed member, the method comprising: heating a steel sheet for hot pressing obtained by the method of producing a steel sheet for hot pressing according to [4] to heating temperature not lower than $Ac_3$ transformation point and not higher than ($Ac_3$+100)° C.; and hot pressing the steel sheet for hot pressing having undergone the heating, whereby the hot pressed member is obtained.

[6] The method of producing a hot pressed member according to [5], wherein, when the steel sheet for hot pressing is heated to the heating temperature, an average heating rate from heating start temperature to the $Ac_3$ transformation point is not lower than 50° C./s.

Advantageous Effects of Invention

The present invention can provide a hot pressed member having excellent indentation peeling strength.

DESCRIPTION OF EMBODIMENTS

[Hot Pressed Member]

A hot pressed member according to the invention is a hot pressed member including a steel sheet and a plating layer on a surface of the steel sheet, wherein the hot pressed member has a tensile strength of not less than 1,780 MPa, ten point height of irregularities Rzjis of a surface of the plating layer is not more than 25 μm, and the steel sheet has a chemical composition containing, by mass %, C: not less than 0.25% and less than 0.50%, Si: not more than 1.5%, Mn: not less than 1.1% and not more than 2.4%, P: not more than 0.05%, S: not more than 0.005%, Al: not less than 0.01% and not more than 0.50%, N: not more than 0.010%, Sb: not less than 0.001% and not more than 0.020%, Nb: not less than 0.005% and not more than 0.15%, and Ti: not less than 0.005% and not more than 0.15%, with the balance being Fe and inevitable impurities, and in a region within 50 μm in a sheet thickness direction from a surface of the steel sheet excluding the plating layer, a microstructure in which prior austenite has an average grain size of not more than 7 μm, and a volume fraction of martensite is not less than 90%.

The hot pressed member of the invention has a tensile strength (TS) of not less than 1,780 MPa since a steel sheet has a specific chemical composition and a specific microstructure.

In addition, the hot pressed member of the invention has excellent indentation peeling strength after projection welding since a steel sheet has a specific chemical composition and a specific microstructure while ten point height of irregularities Rzjis of a surface of a plating layer has a specific value.

Hereinbelow, the "hot pressed member" may be simply called "steel sheet."

<Steel Sheet>

The steel sheet in the hot pressed member according to the invention has a specific chemical composition and a specific microstructure.

The thickness of the steel sheet is not particularly limited and is, for example, not more than 5 mm.

<<Chemical Composition>>

Reasons for the limitation of the chemical composition of the steel sheet are first described. Hereinafter, unless otherwise specified, a "mass %" is expressed simply by "%."

(C: Not Less than 0.25% and Less than 0.50%)

C has a high solid-solution strengthening ability, contributes to an increase in strength of a steel sheet, and is thus an important element in improving strength of steel by strengthening martensite after hot pressing. In order to achieve this effect, an amount of C is not less than 0.25%, preferably not less than 0.27%, more preferably not less than 0.30%, and further preferably not less than 0.32%.

On the other hand, an excessive amount of C leads to a higher hardness of a portion of a steel sheet near an interface between a nut and the steel sheet that have been projection welded. Hence, toughness is decreased, lowering the indentation peeling strength. Accordingly, an amount of C is less than 0.50%, preferably not more than 0.47%, more preferably not more than 0.42%, and further preferably not more than 0.40%.

(Si: Not More than 1.5%)

Si has a high solid-solution strengthening ability in ferrite and thus contributes to an increase in strength of a steel sheet. Meanwhile, an excessive amount of Si leads to a higher hardness of a portion of a steel sheet near an interface between a nut and the steel sheet that have been projection welded. Hence, toughness is decreased, lowering the indentation peeling strength. In addition, Si-based oxides are easily formed in a steel sheet surface layer when a steel sheet is heated. Hence, ten point height of irregularities of a surface of a plating layer after plating treatment becomes large. This becomes another reason for the lower indentation peeling strength. Accordingly, an amount of Si is not more than 1.5%, preferably not more than 1.2%, more preferably not more than 0.9%, and further preferably not more than 0.7%.

On the other hand, while the lower limit thereof is not particularly limited, an amount of Si is preferably not less than 0.005%, more preferably not less than 0.03%, further preferably not less than 0.1% and particularly preferably not less than 0.3%, because an extreme decrease of Si leads to an increase in steelmaking cost.

(Mn: Not Less than 1.1% and not More than 2.4%)

Mn is an element that contributes to an increase in strength of a steel sheet through solid-solution strengthening or improvement in hardenability and, in addition, serves as an austenite stabilizing element. Hence, Mn is an essential element for ensuring martensite after hot pressing. In order to achieve this effect, an amount of Mn is not less than 1.1%, preferably not less than 1.2%, more preferably not less than 1.3%, and further preferably not less than 1.4%.

On the other hand, an excessive amount of Mn leads to a higher hardness of a portion of a steel sheet near an interface between a nut and the steel sheet that have been projection welded. Hence, toughness is decreased, lowering the indentation peeling strength. Accordingly, an amount of Mn is not more than 2.4%, preferably not more than 2.2%, more preferably not more than 2.0%, and further preferably not more than 1.8%.

(P: Not More than 0.05%)

P is an element that contributes to an increase in strength of a steel sheet through solid-solution strengthening. Meanwhile, an excessive amount of P causes significant segregation in the grain boundary, thereby embrittling the gain boundary. Hence, the indentation peeling strength after projection welding is lowered. Accordingly, an amount of P is not more than 0.05%, preferably not more than 0.04%, more preferably not more than 0.03%, and further preferably not more than 0.02%.

On the other hand, while the lower limit thereof is not particularly limited, an amount of P is preferably not less than 0.001%, more preferably not less than 0.005%, and further preferably not less than 0.01%.

(S: Not More than 0.005%)

S is segregated in the grain boundary and embrittles steel during hot working, while existing in the steel as a sulfide such as MnS. An excessive amount of S leads to an occurrence of cracking with a sulfide serving as a starting point after projection welding, thus lowering the indentation peeling strength. Hence, an amount of S is not more than 0.005%, preferably not more than 0.004%, more preferably not more than 0.003%, and further preferably not more than 0.002%.

On the other hand, while the lower limit thereof is not particularly limited, an amount of S is preferably not less than 0.0001%, more preferably not less than 0.0005%, and further preferably not less than 0.001%.

(Al: Not Less than 0.01% and not More than 0.50%)

Al is an element that is necessary for deoxidation in the steelmaking process. In order to achieve this effect, an amount of Al is not less than 0.01%, preferably not less than 0.02%, more preferably not less than 0.03%, and further preferably not less than 0.04%.

On the other hand, because this effect saturates, an amount of Al is not more than 0.50%, preferably not more than 0.40%, more preferably not more than 0.20%, and further preferably not more than 0.10%.

(N: Not More than 0.010%)

N exists in steel as a nitride. An excessive amount of N leads to an occurrence of cracking with a nitride serving as a starting point after projection welding, thus lowering the indentation peeling strength. Hence, an amount of N is not more than 0.010%, preferably not more than 0.008%, more preferably not more than 0.006%, and further preferably not more than 0.004%.

On the other hand, while the lower limit thereof is not particularly limited, an amount of N is preferably not less than 0.001%, and more preferably not less than 0.002%.

(Sb: Not Less than 0.001% and not More than 0.020%)

In the process of obtaining a hot pressed member, a decarburized layer may be generated in a steel sheet in the course of the heating of a steel sheet for hot pressing before the start of cooling following the hot pressing. Sb suppresses generation of such decarburized layer. Hence, it is possible to obtain martensite with a desired volume fraction in a steel sheet surface layer portion. In order to achieve this effect, an amount of Sb is not less than 0.001%, preferably not less than 0.002%, more preferably not less than 0.003%, and further preferably not less than 0.004%.

On the other hand, because this effect saturates, an amount of Sb is not more than 0.020%, preferably not more than 0.018%, more preferably not more than 0.015%, and further preferably not more than 0.012%.

(Nb: Not Less than 0.005% and not More than 0.15%)

Nb not only forms fine carbides or nitrides but suppresses the coarsening of crystal grains and refines the grain size of prior austenite after the hot pressing. Accordingly, the indentation peeling strength after projection welding is improved. In order to achieve this effect, an amount of Nb is not less than 0.005%, preferably not less than 0.010%, more preferably not less than 0.015%, and further preferably not less than 0.020%.

On the other hand, because this effect saturates, an amount of Nb is not more than 0.15%, preferably not more than 0.12%, more preferably not more than 0.10%, and further preferably not more than 0.08%.

(Ti: Not Less than 0.005% and not More than 0.15%)

Ti not only forms fine carbides or nitrides but suppresses the coarsening of crystal grains and refines the grain size of prior austenite after the hot pressing. Accordingly, the indentation peeling strength after projection welding is improved. In order to achieve this effect, an amount of Ti is not less than 0.005%, preferably not less than 0.010%, more preferably not less than 0.015%, and further preferably not less than 0.020%.

On the other hand, because this effect saturates, an amount of Ti is not more than 0.15%, preferably not more than 0.12%, more preferably not more than 0.10%, and further preferably not more than 0.08%.

The chemical composition of a steel sheet can further contain at least one selected from the group consisting of, by mass %, B: not more than 0.0050%, Mo: not more than 0.50%, Cr: not more than 0.50%, Ca: not more than 0.005%, Mg: not more than 0.005%, REM: not more than 0.005%, V: not more than 0.15%, Cu: not more than 0.50%, Ni: not more than 0.50%, Sn: not more than 0.50%, Zn: not more than 0.10%, and Ta: not more than 0.10%.

(B: Not More than 0.0050%)

B is an element that is effective in improving hardenability and assuring martensite after hot pressing. B is also effective in improving the indentation peeling strength after projection welding because B is segregated in the grain boundary to increase the grain boundary strength. In order to achieve this effect, an amount of B is preferably not less than 0.0002%, more preferably not less than 0.0008%, and further preferably not less than 0.0012%.

On the other hand, an excessive amount of B may impair toughness, lowering the indentation peeling strength after projection welding in some cases. Hence, an amount of B is preferably not more than 0.0050%, more preferably not more than 0.0035%, and further preferably not more than 0.0030%.

(Mo: Not More than 0.50%)

Mo contributes to an increase in strength of a steel sheet through solid-solution strengthening, improves hardenability, and is an element that is effective in generation of martensite after hot pressing. In order to achieve this effect, an amount of Mo is preferably not less than 0.005%, more preferably not less than 0.01%, and further preferably not less than 0.05%.

On the other hand, because this effect saturates, an amount of Mo is preferably not more than 0.50%, more preferably not more than 0.35%, and further preferably not more than 0.25%.

(Cr: Not More than 0.50%)

Cr contributes to an increase in strength of a steel sheet through solid-solution strengthening, improves hardenability, and is an element that is effective in generation of martensite after hot pressing. In order to achieve this effect, an amount of Cr is preferably not less than 0.005%, more preferably not less than 0.01%, and further preferably not less than 0.05%.

On the other hand, with an excessive amount of Cr, this effect saturates, and besides oxides may be formed on a surface to impair the platability in some cases. Hence, an amount of Cr is preferably not more than 0.50%, more preferably not more than 0.35%, and further preferably not more than 0.28%.

(Ca: Not More than 0.005%, Mg: Not More than 0.005%, REM: Not More than 0.005%)

All of Ca, Mg and REM are elements that are used in deoxidation and, besides, control the shapes of sulfides and oxides and suppress generation of coarse inclusions. Hence, toughness after projection welding is improved, and the indentation peeling strength is improved. Accordingly, an amount of each of Ca, Mg and REM is preferably not less than 0.0002%, more preferably not less than 0.0004%, and further preferably not less than 0.0006%.

On the other hand, an excessive amount of each of Ca, Mg or REM leads to an increase of inclusions, whereby cracking may easily occur with the inclusions serving as starting points after projection welding, lowering the indentation peeling strength in some cases. Accordingly, an amount of each of Ca, Mg and REM is preferably not more than 0.005%, more preferably not more than 0.004%, and further preferably not more than 0.002%.

It should be noted that Rare Earth Metal (REM) is a generic term for the total 17 elements including two elements of scandium (Sc) and yttrium (Y) and 15 elements (lanthanoid elements) of from lanthanum (La) to lutetium (Lu).

(V: Not More than 0.15%)

V is an element that contributes to an increase in strength through formation of fine carbides. Hence, an amount of V is preferably not less than 0.02%, more preferably not less than 0.04%, and further preferably not less than 0.06%.

On the other hand, an excessive amount of V may lower toughness after projection welding and may lower the indentation peeling strength in some cases. Accordingly, an amount of V is preferably not more than 0.15%, more preferably not more than 0.12%, and further preferably not more than 0.10%.

(Cu: Not More than 0.50%)

Cu is an element that contributes to an increase in strength through solid-solution strengthening. Accordingly, an amount of Cu is preferably not less than 0.02%, more preferably not less than 0.04%, and further preferably not less than 0.08%.

On the other hand, because this effect saturates, an amount of Cu is preferably not more than 0.50%, more preferably not more than 0.40%, and further preferably not more than 0.30%.

(Ni: Not More than 0.50%)

Ni is an austenite stabilizing element. Hence, Ni promotes austenite transformation during the heating process of hot pressing, allowing martensite with a desired volume fraction to be easily obtained after hot pressing. Accordingly, an amount of Ni is preferably not less than 0.02%, more preferably not less than 0.04%, and further preferably not less than 0.08%.

On the other hand, an excessive amount of Ni may lower toughness after projection welding and may lower the indentation peeling strength in some cases. Accordingly, an amount of Ni is preferably not more than 0.50%, more preferably not more than 0.40%, and further preferably not more than 0.30%.

(Sn: Not More than 0.50%)

In the process of obtaining a hot pressed member, a decarburized layer may be generated in a steel sheet in the course of the heating of a steel sheet for hot pressing before the start of cooling following the hot pressing. Sn suppresses generation of such decarburized layer. Hence, martensite with a desired volume fraction can be easily obtained in a steel sheet surface layer portion. In order to achieve this effect, an amount of Sn is preferably not less than 0.001%, more preferably not less than 0.03%, and further preferably not less than 0.07%.

On the other hand, because this effect saturates, an amount of Sn is preferably not more than 0.50%, more preferably not more than 0.40%, and further preferably not more than 0.30%.

(Zn: Not More than 0.10%)

Zn improves hardenability in the process of hot pressing and is thus an element that contributes to an increase in strength through formation of martensite after hot pressing. Hence, an amount of Zn is preferably not less than 0.01%, more preferably not less than 0.02%, and further preferably not less than 0.03%.

On the other hand, an excessive amount of Zn may lower toughness after projection welding and may lower the indentation peeling strength in some cases. Accordingly, an amount of Zn is preferably not more than 0.10%, more preferably not more than 0.08%, and further preferably not more than 0.06%.

(Ta: Not More than 0.10%)

Ta contributes to an increase in strength through generation of carbides or nitrides. Accordingly, an amount of Ta is preferably not less than 0.01%, more preferably not less than 0.02%, and further preferably not less than 0.03%.

On the other hand, because this effect saturates, an amount of Ta is preferably not more than 0.10%, more preferably not more than 0.08%, and further preferably not more than 0.06%.

(Balance)

In the chemical composition of a steel sheet, the balance as a result of excluding the above-described components consists of Fe and inevitable impurities.

<<Microstructure>>

Next, described is the microstructure in a region within 50 μm in a sheet thickness direction from a surface of a steel sheet excluding a plating layer.

(Average Grain Size of Prior Austenite: Not More than 7 μm)

The average grain size of prior austenite in a region within 50 μm in a sheet thickness direction from a surface of a steel sheet excluding a plating layer (hereinbelow, also simply referred to as "average grain size of prior austenite") influences toughness of a steel sheet. When the grain size is too large, toughness is impaired, and the indentation peeling strength after projection welding is lowered.

Accordingly, the average grain size of prior austenite is 7 μm, preferably not more than 6 μm, and more preferably not more than 5.5 μm.

While the lower limit thereof is not particularly limited, the average grain size of prior austenite is preferably not less than 0.5 μm, more preferably not less than 1 μm, and further preferably not less than 1.5 μm.

(Volume Fraction of Martensite: Not Less than 90%)

The volume fraction of martensite in a region within 50 μm in a sheet thickness direction from a surface of a steel sheet excluding a plating layer (hereinbelow, also simply referred to as "volume fraction of martensite") is not less than 90%. With this constitution, a tensile strength of not less than 1,780 MPa can be obtained. The volume fraction of martensite is preferably not less than 93%, more preferably not less than 95%, and further preferably not less than 96%. The upper limit thereof is, for example, 100%.

The remaining structure may include, for example, ferrite, bainite and perlite. The remaining structure is, in total, preferably not more than 10%, more preferably not more than 7%, further preferably not more than 5%, and particularly preferably not more than 4%.

<Plating Layer>

The hot pressed member of the invention has a plating layer on a surface of the foregoing steel sheet. With this constitution, the hot pressed member of the invention is excellent in corrosion resistance and other properties. The thickness of the plating layer is not particularly limited and appropriately selected depending on, for example, the intended use.

The plating layer is not particularly limited, and suitable examples thereof include a Zn-based plating layer (plating layer containing Zn), a Zn—Ni-based plating layer (plating layer containing Zn and Ni) and an Al-based plating layer (plating layer containing Al).

A Zn-based plating layer, a Zn—Ni-based plating layer and an Al-based plating layer may be each a plating layer containing, in addition to its main component of Zn, Ni or Al, elements such as Si, Mg, Ni, Fe, Sn, Pb, Be, B, P, S, Ti, V, W, Mo, Sb, Cd, Nb, Cr and Sr (any one of those alone or two or more of those in combination may be used).

The plating layer of the hot pressed member of the invention is formed in such a manner that a plating layer of a steel sheet for hot pressing to be described later undergoes heating and hot pressing to be described later.

In a case where the hot pressed member of the invention has a Zn-based plating layer, for example, a plating layer containing Zn of a steel sheet for hot pressing is heated and hot pressed, whereby the Zn-based plating layer is formed.

<<Thickness of Oxide Layer on Surface of Plating Layer: Not More than 5 μm>>

When a steel sheet for hot pressing is heated, an oxide layer may be formed on a surface of a plating layer in some cases. In other words, the hot pressed member of the invention sometimes has an oxide layer on a surface of its plating layer.

When the oxide layer on a surface of the plating layer is too thick, the electric resistance increases during projection welding, and, in addition, the indentation peeling strength after projection welding may be insufficient.

For instance, a case where the plating layer is a Zn-based layer or a Zn—Ni-based layer is discussed. In this case, a ZnO layer having a high electric resistance value is formed on a surface of the plating layer. A ZnO layer being too thick may inhibit formation of an energizing path when a nut having a projection is welded, whereby welding may not be easily carried out.

Accordingly, the thickness of the oxide layer on a surface of the plating layer is preferably not more than 5 μm, more preferably not more than 4 μm, and further preferably not more than 3 μm, because the indentation peeling strength after projection welding is more excellent.

<Ten Point Height of Irregularities Rzjis: Not More than 25 μm>

The hot pressed member of the invention has a ten point height of irregularities Rzjis of a surface of the plating layer of not more than 25 μm.

When a nut having a projection is welded to a steel sheet (hot pressed member) having a tensile strength of not less than 1,780 Mpa, presumably, only the projection of the nut and a very surface layer of the steel sheet are melted, the melted very surface layer is repelled from the steel sheet, and the nut is welded onto a newly generated surface of the steel sheet. Therefore, the surface shape of the plating layer is controlled. In order to have sufficiently tight adherence between the projection of the nut and a surface of the plating layer and to obtain excellent indentation peeling strength, the ten point height of irregularities Rzjis of a surface of the plating layer is set to not more than 25 μm.

In the hot pressed member of the invention, the plating layer has a surface shape corresponding to the surface shape of the steel sheet.

The ten point height of irregularities Rzjis of a surface of the plating layer is preferably not more than 20.0 μm, and more preferably not more than 15.0 μm, because the indentation peeling strength is more excellent.

The lower limit thereof is not particularly limited and is preferably not more than 1.0 μm.

<Tensile Strength: Not Less than 1,780 MPa>

The hot pressed member of the invention has a tensile strength of not less than 1,780 MPa.

The tensile strength is preferably not less than 1,800 MPa, and more preferably not less than 1,810 MPa. While the upper limit thereof is not particularly limited, the tensile strength is preferably not more than 2,500 MPa.

[Method of Producing Steel Sheet for Hot Pressing]

The method of producing a steel sheet for hot pressing according to the invention is next described.

The method of producing a steel sheet for hot pressing according to the invention includes: heating a steel material having the foregoing chemical composition at temperature of not lower than 1,100° C. and not higher than 1,250° C. for not less than 30 minutes and not more than 120 minutes; hot rolling the steel material having undergone the heating at finish rolling temperature of not lower than 860° C. and not higher than 950° C. to obtain a hot rolled steel sheet; coiling the hot rolled steel sheet at coiling temperature of not higher than 500° C.; pickling the hot rolled steel sheet having undergone the coiling using an acid liquid at temperature of not lower than 20° C. and not higher than 70° C. for not less than 10 seconds and not more than 100 seconds; cold rolling the hot rolled steel sheet having undergone the pickling to obtain a cold rolled steel sheet; subjecting the cold rolled steel sheet to annealing comprising a first annealing and a second annealing; and plating the cold rolled steel sheet having undergone the annealing, whereby the steel sheet for hot pressing is obtained.

Meanwhile, in the first annealing, the cold rolled steel sheet is retained at temperature of not lower than 850° C. and not higher than 950° C. for not more than 600 seconds, subsequently cooled to cooling stop temperature of not lower then 350° C. and not higher than 450° C., retained at the cooling stop temperature for not less than 60 seconds and not more than 1,800 seconds, and thereafter cooled to room temperature, and in the second annealing, the cold rolled steel sheet having been subjected to the first annealing is retained at temperature of not lower than 720° C. and not higher than 850° C. for not less than 15 seconds, and subsequently cooled to cooling stop temperature of not higher than 600° C. at an average cooling rate of not lower than 5° C./s.

The steel sheet for hot pressing obtained by the method of producing a steel sheet for hot pressing according to the invention is further subjected to hot pressing (to be described later), whereby the hot pressed member of the invention described above can be obtained.

Next, the respective steps in the method of producing a steel sheet for hot pressing according to the invention will be described in detail.

<Slab Heating Temperature: Not Lower than 1,100° C. and not Higher than 1,250° C., and Slab Heating Time: Not Less than 30 Minutes and not More than 120 Minutes>

A slab that is a steel material is hot rolled, whereby a hot rolled steel sheet is obtained. Hereinafter, the hot rolled steel sheet may also be simply referred to as "steel sheet."

A slab is heated before being hot rolled. In this process, a slab having been casted is not reheated but retained at temperature of not lower than 1,100° C. for not less than 30 minutes, and the hot rolling is started, or, alternatively, the slab is reheated to temperature of not lower than 1,100° C. and subsequently retained for not less than 30 minutes, and the hot rolling is started.

This heating process is important for re-solution of Ti and Nb that have been precipitated during the casting process.

When the slab heating temperature is lower than 1,100° C. or the slab heating time is less than 30 minutes, Ti and Nb do not sufficiently undergo re-solution. In that case, coarse carbides of Ti and Nb are generated in the steel sheet that has been annealed, and the indentation peeling strength after projection welding is lowered.

On the other hand, when the slab heating temperature is higher than 1,250° C. or the slab heating temperature is more than 120 minutes, iron oxides containing Si are excessively generated in a steel sheet surface layer and are not sufficiently removed by descaling or pickling after hot rolling. Accordingly, the ten point height of irregularities of the hot pressed member following hot pressing becomes large.

Therefore, the slab heating temperature is not lower than 1,100° C. and not higher than 1,250° C., while the slab heating time is not less than 30 minutes and not more than 120 minutes.

The slab heating temperature is preferably not lower than 1,110° C. and not higher than 1,240° C.

The slab heating time is preferably not less than 40 minutes and not more than 110 minutes.

The present invention can employ a method in which a slab having been casted is once cooled to room temperature and then re-heated; a method in which a casted slab is not cooled and is placed as a warm slab in a heating furnace; a method in which a casted slab is subjected to heat retention, immediately followed by rolling; and a method in which a slab having been casted is directly subjected to rolling.

<Finish Rolling Temperature: Not Lower than 860° C. and not Higher than 950° C.>

The hot rolling process homogenizes the structure in a steel sheet and reduces anisotropy of the material. Owing to this process, resistance to resistance-weld cracking after annealing is improved. Accordingly, the hot rolling needs to be terminated in the austenite single phase region. In addition, Sb needs to be concentrated in a steel sheet surface layer while the hot rolling is performed in a high temperature range. Therefore, the finish rolling temperature of the hot rolling (temperature at which the finish rolling is terminated) is not lower than 860° C. When the finish rolling temperature is too low, the volume fraction of martensite decreases.

On the other hand, when the finish rolling temperature is too high, the structure of the hot rolled steel sheet becomes coarse, and crystal grains after annealing are also coarsened. In addition, Si-based iron oxides are excessively generated and are not sufficiently removed by descaling or pickling after hot rolling. Accordingly, the finish rolling temperature is not higher than 950° C., and preferably not higher than 940° C.

<Coiling Temperature: Not Higher than 500° C.>

The hot rolled steel sheet obtained through the hot rolling process is cooled and coiled at the coiling temperature.

When the coiling temperature is higher than 500° C., ferrite and perlite are excessively generated in the steel sheet structure of the hot rolled steel sheet, making it difficult to ensure the predetermined fraction volume of martensite, whereby a tensile strength of not less than 1,780 MPa cannot be obtained. Hence, the coiling temperature is not higher than 500° C., and preferably not higher than 470° C.

While the lower limit thereof is not particularly limited, when the coiling temperature is too low, hard martensite is excessively generated, and the load during cold rolling is likely to increase. Therefore, the coiling temperature is preferably not lower than 300° C., and more preferably not lower than 350° C.

Next, the hot rolled steel sheet thus coiled is subjected to pickling. Through this process, a scale in a surface layer of the hot rolled steel sheet is removed. Examples of an acid liquid used in the pickling process include hydrochloric acid, sulfuric acid, nitric acid and oxalic acid, which may be used alone or in combination of two or more thereof.

A scale generated during the hot rolling includes, for example, $SiO_2$ or Si—Mn-based composite oxide. Such a scale causes a problem when the plating treatment described later is performed and thus needs to be removed. A Si—Mn-based composite oxide is easily dissolved in acid. On the other hand, $SiO_2$ is poorly soluble in acid compared to a Si—Mn-based composite oxide, and therefore temperature of an acid liquid and pickling time are important.

<Temperature of Acid Liquid: Not Lower than 20° C. and not Higher than 70° C.>

Temperature of an acid liquid is not lower than 20° C. At this temperature, $SiO_2$ that is poorly soluble in acid is dissolved. Accordingly, the hot pressed member following hot pressing can achieve the desired ten point height of irregularities and has excellent indentation peeling strength.

Meanwhile, when temperature of an acid liquid is too high, not only an oxide but also steel sheet (steel matrix) is removed. Therefore, temperature of an acid liquid is not higher than 70° C., and preferably not higher than 60° C.

<Pickling Time: Not Less than 10 Seconds and not More than 100 Seconds>

The pickling time is not less than 10 seconds. With this pickling time, $SiO_2$ that is poorly soluble in acid is dissolved. Accordingly, the hot pressed member following hot pressing can achieve the desired ten point height of irregularities and has excellent indentation peeling strength. Because a value of the ten point height of irregularities becomes smaller, leading to the more excellent indentation peeling strength, the pickling time is preferably not less than 15 seconds, and more preferably not less than 20 seconds.

Meanwhile, when the pickling time is too long, not only an oxide but also steel sheet (steel matrix) is removed. Therefore, the pickling time is not more than 100 seconds, and preferably not more than 95 seconds.

<Cold Rolling>

Next, the hot rolled steel sheet having been pickled is subjected to cold rolling. Through this process, a cold rolled steel sheet having a predetermined sheet thickness is obtained. Hereinafter, the cold rolled steel sheet is also simply referred to as "steel sheet." The method for cold rolling is not particularly limited, and the cold rolling may be carried out according to an ordinary method.

Next, the obtained cold rolled steel sheet is subjected to annealing. The annealing process includes a first annealing and a second annealing to be described below.

<First Annealing>

The first annealing promotes recrystallization after cold rolling and controls the structure of the steel sheet following hot pressing. Nb and Ti dissolved in the form of solid solution in the steel sheet that has been hot rolled are finely precipitated by annealing the steel sheet in the single phase region of austenite, followed by rapid cooling. In addition, since a single phase of martensite is formed, nucleation sites increase during the second annealing, and the steel sheet structure is refined.

<<Soaking Temperature: Not Lower than 850° C. but not Higher than 950° C.>>

The soaking temperature in the first annealing corresponds to the single phase region of austenite. When the soaking temperature is too low, recrystallization does not sufficiently proceeds, whereby the steel sheet structure generated in the second annealing is coarsened. Accordingly, the desired grain size of prior austenite cannot be obtained following hot pressing. Therefore, the soaking temperature is not lower than 850° C., and preferably not lower than 860° C.

Meanwhile, when the soaking temperature is too high, crystal grains are coarsened. Therefore, the soaking temperature is not higher than 950° C., and preferably not higher than 940° C.

<<Retaining Time at Soaking Temperature: Not More than 600 Seconds>>

The steel sheet is retained at the foregoing soaking temperature. Through this process, recrystallization sufficiently proceeds, and the desired grain size of prior austenite is obtained following hot pressing. Therefore, the retaining time at the soaking temperature is preferably not less than 5 seconds, more preferably not less than 50 seconds, and further preferably not less than 100 seconds.

Meanwhile, because the grain size of prior austenite becomes large when the retaining time is too long, the retaining time at the soaking temperature is not more than 600 seconds, and preferably not more than 580 seconds.

<<Cooling Stop Temperature: Not Lower than 300° C. and not Higher than 450° C.>>

Next, the steel sheet having been retained at the soaking time is cooled to the cooling stop temperature and retained.

When the cooling stop temperature is too low, martensite is excessively generated. Accordingly, the refining effect to the steel sheet structure is reduced. Therefore, the cooling stop temperature is not lower than 300° C., preferably not lower than 320° C., and more preferably not lower than 340° C.

Meanwhile, when the cooling stop temperature is too high, it is difficult to ensure the desired grain size of prior austenite following hot pressing. Therefore, the cooling stop temperature is not higher than 450° C., and preferably not higher than 440° C.

<<Retaining Time at Cooling Stop Temperature: Not Less than 60 Seconds and not More than 1,800 Seconds>>

When the retaining time at the cooling stop temperature is too short, martensite is excessively generated. Accordingly, the refining effect to the steel sheet structure is reduced. Therefore, the retaining time at cooling stop temperature is not less than 60 seconds, preferably not less than 120 seconds, and more preferably not less than 180 seconds.

Meanwhile, when the steel sheet is retained at the cooling stop temperature for a long period of time, the structure transformation substantially completes.

Accordingly, the retaining time at the cooling stop temperature is not more than 1,800 seconds, and preferably not more than 1,600 seconds.

The steel sheet having been retained at the cooling stop temperature is cooled to room temperature.

<Second Annealing>

The steel sheet having been subjected to the first annealing is next subjected to the second annealing. First, the cooled steel sheet is heated and retained at the soaking temperature.

<<Soaking Temperature: Not Lower than 720° C. and not Higher than 850° C.>>

The soaking temperature in the second annealing corresponds to a dual phase region of ferrite and austenite. When the soaking temperature is too low, ferrite increases. Accordingly, the desired volume fraction of martensite cannot be obtained following hot pressing. Therefore, the soaking temperature is not lower than 720° C., and preferably not lower than 740° C.

Meanwhile, when the soaking temperature is too high, crystal grains are coarsened. Accordingly, the desired grain size of prior austenite cannot be obtained following hot pressing. Therefore, the soaking temperature is not higher than 850° C., and preferably not higher than 840° C.

<<Retaining Time at Soaking Temperature: Not Less than 15 Seconds>>

The steel sheet is retained at the foregoing soaking temperature. When the retaining time at the soaking temperature is too short, ferrite increases, and the desired volume fraction of martensite cannot be obtained following hot pressing. Therefore, the retaining time at the soaking temperature is not less than 15 seconds, preferably not less than 25 seconds, and more preferably not less than 40 seconds.

While the upper limit thereof is not particularly limited, the retaining time at the soaking temperature is preferably not more than 600 seconds, more preferably not more than 500 seconds, and further preferably not more than 400 seconds.

<<Average Cooling Rate: Not Lower than 5° C./s>>

The steel sheet having been retained at the soaking temperature is next cooled to the cooling stop temperature.

In this process, when the average cooling rate is too low, ferrite transformation proceeds during cooling, whereby the volume fraction of martensite decreases, and carbonitrides of Nb and Ti are coarsened. Further, the indentation peeling strength after projection welding is lowered. Therefore, the average cooling rate is not lower than 5° C./s, preferably not lower than 8° C./s, and more preferably not lower than 10° C./s.

While the upper limit thereof is not particularly limited, the average cooling rate is preferably not higher than 30° C./s, and more preferably not higher than 25° C./s, in terms of the equipment and the cost.

<<Cooling Stop Temperature: Not Higher than 600° C.>>

When the cooling stop temperature is too high, the desired steel sheet structure cannot be obtained following hot pressing. Therefore, the cooling stop temperature is not higher than 600° C., and preferably not higher than 580° C.

While the lower limit thereof is not particularly limited, the cooling stop temperature is preferably not lower than 250° C., more preferably not lower than 300° C., and further preferably not lower than 350° C.

<Plating Treatment>

The steel sheet having been cooled to temperature of not higher than 600° C. is subsequently subjected to the plating treatment to form a plating layer. A steel sheet for hot pressing is obtained in this manner. Owing to the plating layer, the obtained steel sheet for hot pressing is prevented from oxidization occurring in hot pressing to be described later and is also excellent in corrosion resistance.

The method for the plating treatment is not particularly limited and can adopt a known hot dipping method, electroplating method, deposition plating method or the like. The plating treatment may be followed by alloying treatment.

As described above, the plating layer formed by the plating treatment undergoes heating and hot pressing to be described layer, thereby turning into a plating layer of the hot pressed member according to the invention. Hence, the type of the plating layer formed by the plating treatment is appropriated selected depending on the type of the desired plating layer of the hot pressed member according to the invention.

Specifically, preferred examples of the plating layer formed by the plating treatment include a Zn-based plating layer, a Zn—Ni-based plating layer and an Al-based plating layer, as with the foregoing plating layer of the hot pressed member of the invention. In terms of a further improvement in the corrosion resistance or prevention of liquid metal embrittlement induced cracking due to molten Zn during hot pressing, a Zn—Ni-based plating layer is sometimes preferred.

Examples of a Zn-based layer include a hot-dip Zn galvanizing layer formed by a hot dipping method and a Zn galvannealing layer formed by alloying the galvanizing layer.

Examples of a Zn—Ni-based layer include a Zn—Ni alloy electrogalvanizing layer formed by an electroplating method.

Examples of an Al-based layer include a hot-dip Al plating layer formed by a hot dip method.

<Steel Sheet for Hot Pressing>

The microstructure of a (cold rolled) steel sheet in the steel sheet for hot pressing will be described.

In the microstructure in a region within 50 μm in a sheet thickness direction from a surface of the steel sheet excluding a plating layer, the volume fraction of ferrite having an average grain size of not more than 7 μm is preferably not lower than 20%. With this constitution, the desired average grain size of prior austenite is easily obtained following hot pressing.

Meanwhile, when the volume fraction of ferrite is too high, C or Mn is concentrated in a hard phase except ferrite, and the desired grain size of prior austenite can be hardly obtained following hot pressing. Therefore, the volume fraction of ferrite is preferably not higher than 85%.

The steel sheet for hot pressing may be subjected to temper rolling. A preferred elongation percentage in the temper rolling is 0.05 to 2.00%.

[Method of Producing Steel Sheet for Hot Pressing]

The method of producing a hot pressed member of the invention includes: heating the steel sheet for hot pressing obtained by the foregoing method of producing a steel sheet for hot pressing of the invention to temperature not lower than $Ac_3$ transformation point and not higher than ($Ac_3$+100)° C., and hot pressing the steel sheet for hot pressing having undergone the heating, whereby the hot pressed member is obtained.

<Average Heating Rate from Heating Start Temperature to $Ac_3$ Transformation Point: Not Lower than 50° C./s>

First, the steel sheet for hot pressing is heated to the heating temperature to be described later.

The average heating rate from the heating start temperature to the $Ac_3$ transformation point contributes to a thickness of an oxide layer on a surface of the plating layer. Because the oxide layer on a surface of the plating layer is prevented from thickening, and the desired indentation peeling strength is easily obtained, the average heating rate from the heating start temperature to the $Ac_3$ transformation point is preferably not lower than 50° C./s, more preferably not lower than 55° C./s, and further preferably not lower than 60° C./s. Meanwhile, the upper limit thereof is not particularly limited and is, for example, not higher than 150° C./s, and preferably not higher than 120° C./s.

The heating start temperature is not particularly limited and is, for example, not lower than 0° C. and not higher than 60° C.

As the heating method, a known method can be adopted, and, for example, the steel sheet for hot pressing is heated using an electric furnace, a gas furnace, an electrical resistance heating furnace, or a far-infrared heating furnace.

<Heating Temperature: Not Lower than $Ac_3$ Transformation Point and not Higher than ($Ac_3$+100)° C.>

The $Ac_3$ transformation point (unit: ° C.) is determined by the following equation.

$$Ac_3 \text{ transformation point} = 881 - 206C + 53Si - 15Mn - 20Ni - 1Cr - 27Cu + 41Mo$$

It should be noted that element symbols in the equation each represent an amount (unit: mass %) of the element in the chemical composition, and when a certain element is not contained, 0 is assigned in calculation.

When the heating temperature is lower than the $Ac_3$ transformation point, a large amount of ferrite remains in the steel sheet structure. Accordingly, it becomes difficult to obtain the desired volume fraction of martensite in the steel sheet structure following hot pressing.

Meanwhile, when the heating temperature exceeds the ($Ac_3$+100)° C., oxidization or alloying of the plating layer excessively proceeds. Accordingly, the ten point height of irregularities of a surface of the plating layer becomes large. In addition, the plating layer evaporates, whereby the steel sheet (steel matrix) may be exposed in some cases. Therefore, the heating temperature is not higher than the ($Ac_3$+100)° C.

In order for the steel sheet for hot pressing to have a uniform temperature within the (cold rolled) steel sheet, heating time (retaining time at the heating temperature) is preferably not less than 1 second. Meanwhile, because this effect saturates, the heating time is preferably not more than 600 seconds.

<Hot Pressing>

The steel sheet for hot pressing heated to the foregoing heating temperature as described above is subsequently subjected to hot pressing. The foregoing hot pressed member of the invention is obtained in this manner. The method of hot pressing is not particularly limited, and a conventionally known method can be suitably employed.

Examples

The invention is specifically described below with reference to Examples. However, the present invention is not limited thereto. The invention can be carried out with appropriate modifications within the suitable scope of the invention.

<Method of Producing Steel Sheet for Hot Pressing)

Steel having the chemical composition shown in Table 1 below (with the balance of Fe and inevitable impurities) was melted and subjected to continuous casting, whereby a slab (steel material) was obtained.

The obtained slab was heated under the conditions (slab heating temperature and time) shown in Tables 2 and 3 below. The heated slab was subjected to hot rolling at the finish rolling temperature shown in the Tables, whereby a hot rolled steel sheet was obtained. The obtained hot rolled steel sheet was coiled at the coiling temperature shown in the Tables. The hot rolled steel sheet thus coiled was pickled under the conditions (acid liquid temperature and pickling time) shown in the Tables. The hot rolled steel sheet thus pickled was subjected to cold rolling, whereby a cold rolled steel sheet (sheet thickness: 1.4 mm) was obtained. The obtained cold rolled steel sheet was subjected to the first annealing and the second annealing under the conditions shown in the Tables.

The cold rolled steel sheet cooled to the cooling stop temperature of the second annealing was subjected to plating treatment, whereby a plating layer of the plating type shown in Tables 2 and 3 below was formed.

Specifically, in some examples, following the annealing process, hot-dip Zn galvanizing treatment was performed in a continuous hot-dip plating line, whereby a hot-dip Zn galvanizing layer was formed (where "Zn" is shown in Tables 2 and 3 below).

In other examples, following the annealing process in a continuous annealing line, a Zn—Ni alloy electrogalvanizing layer was formed in a Zn electrogalvanizing line (where "Zn—Ni" is shown in Tables 2 and 3 below).

In still other examples, following the annealing process, a hot-dip Al plating treatment was performed in a continuous hot-dip plating line, whereby a hot-dip Al plating layer was formed (where "Al" is shown in Tables 2 and 3 below).

The steel sheet (cold rolled steel sheet) having the plating layer formed on its surface obtained in the foregoing manner was treated as the steel sheet for hot pressing.

<Production of Hot Pressed Member>

The obtained steel sheet for hot pressing was heated in the atmosphere using an atmospheric heating furnace to heating temperature at the average heating rate shown in Tables 2 and 3 below, subjected to hot pressing, and thereafter cooled. The steel sheet for hot pressing having been subjected to hot pressing obtained in the foregoing manner was treated as the hot pressed member.

A die used for hot pressing had a punch width of 70 mm, a punch shoulder R of 4 mm, and a die shoulder R of 4 mm. A forming depth was 30 mm.

Following the hot pressing, the member was cooled. Specifically, the member was cooled by being held between a punch and a die and, in addition, cooled with air on the die released from the holding state so that the member was cooled from the pressing temperature to 150° C. In this process, the cooling rate was adjusted by varying the retaining time for retaining the punch at the bottom dead center within the range of 1 to 60 seconds.

<Microstructure>

The microstructure of steel sheet (cold rolled steel sheet) in the obtained hot pressed member was observed, and the volume fraction of martensite and the average grain size of prior austenite were determined. The results are shown in Tables 4 and 5 below.

Specifically, first, the hot pressed member was polished such that a cross section (cross section parallel to the rolling direction of the steel sheet) in a region within 50 μm in the sheet thickness direction from a surface of the steel sheet excluding the plating layer became an observation surface. The observation surface of the steel sheet having been polished was etched using 3 vol % Nital and observed with a scanning electron microscope (SEM) at a magnification of 5,000×, whereby an SEM image was obtained. For the SEM image analysis, Image-Pro available from Media Cybernetics Inc. was used as analysis software. An area ratio of white phases of contrast in the obtained SEM image was measured and determined as the volume fraction of martensite (unit: %).

Based on the obtained SEM image, crystal grains of prior austenite were identified, and an area thereof was determined. A value of a circle equivalent diameter was calculated from the determined area. An average of the calculated values was determined as the average grain size of prior austenite (unit: μm).

<Thickness of Oxide Layer on Surface of Plating Layer>

In the same manner as the foregoing method, the obtained hot pressed member was observed using an SEM at a magnification of 1,000×, and an SEM image of the plating layer was obtained. Using the obtained SEM image, a thickness of an oxide layer formed in a surface layer of the plating layer was measured at five points, and an average value of the measurements was determined as a thickness of the oxide layer on a surface of the plating layer (unit: μm). The results are shown in Tables 4 and 5 below.

<Tensile Strength>

A JIS No. 5 tensile test specimen was sampled from a hat bottom part of the obtained hot pressed member. Using the specimen thus sampled, a tensile test was performed in accordance with JIS Z 2241, and the tensile strength (TS) was measured. The results thereof are shown in Tables 4 and 5 below.

<Ten Point Height of Irregularities Rzjis>

Ten point height of irregularities Rzjis of a surface of the plating layer in the obtained hot pressed member was measured in accordance with JIS B 0601:2013. With a measurement length of 4.0 mm and a cut-off value of 0.8 mm, the ten point height of irregularities Rzjis was determined. The results are shown in Tables 4 and 5 below.

<Indentation Peeling Strength>

A specimen in a size of 50 mm×150 mm was sampled from the obtained hot pressed member. At the center of the sampled specimen, a hole with a diameter of 10 mm was formed. An M6 weld nut having four projections was set to an AC welder such that the center of the hole in the specimen coincided with the center of a nut hole. Resistance welding was performed in a servomotor pressurizing mode applied to a welding gun with a single phase alternating current (50 Hz), and a specimen having a projection welded portion (hereinafter, also referred to as "welded body") was prepared. A pair of electrode tips (flat type electrode with a diameter of 30 mm) were used. For the welding conditions, the pressure was 3,000N, the energizing cycle was 7 cycles (50 Hz), the welding current was 12 kA, and the holding time was 10 cycles (50 Hz).

A bolt was fixed to the nut hole of the obtained welded body. Subsequently, the load applied when the nut was peeled from the specimen was measured by an indentation peeling test in accordance with JIS B 1196:2001. When the load was not smaller than 8.0 kN, the indentation peeling strength of the projection welded portion was evaluated as excellent (A), when the load was smaller than 8.0 kN but not smaller than 6.5 kN, the indentation peeling strength was evaluated as good (B), and when the load was smaller than 6.5 kN, the indentation peeling strength was evaluated as insufficient (C). The results thereof are shown in Tables 4 and 5 below.

TABLE 1

| Steel type | Chemical composition [mass %] C | Si | Mn | P | S | Al | N | Sb | Nb | Ti | Other components | $Ac_3$ [° C.] | Remarks |
|---|---|---|---|---|---|---|---|---|---|---|---|---|---|
| A | 0.28 | 0.6 | 2.3 | 0.02 | 0.002 | 0.04 | 0.004 | 0.0060 | 0.073 | 0.033 | | 821 | Inventive steel |
| B | 0.31 | 1.2 | 1.9 | 0.01 | 0.001 | 0.03 | 0.003 | 0.0040 | 0.025 | 0.084 | B: 0.0022 | 850 | Inventive steel |
| C | 0.47 | 0.4 | 1.4 | 0.02 | 0.003 | 0.05 | 0.005 | 0.0110 | 0.064 | 0.028 | Mo: 0.15, Cr: 0.25 | 788 | Inventive steel |
| D | 0.38 | 1.4 | 2.0 | 0.03 | 0.001 | 0.02 | 0.004 | 0.0130 | 0.085 | 0.056 | Ca: 0.0015 | 849 | Inventive steel |
| E | 0.30 | 0.7 | 1.6 | 0.01 | 0.001 | 0.39 | 0.004 | 0.0080 | 0.015 | 0.064 | V: 0.08, Cu: 0.15, Ni: 0.15 | 825 | Inventive steel |
| F | 0.29 | 1.0 | 2.2 | 0.01 | 0.002 | 0.02 | 0.006 | 0.0170 | 0.052 | 0.035 | Sn: 0.15, Zn: 0.05, Ta: 0.04 | 841 | Inventive steel |
| G | 0.39 | 0.5 | 1.3 | 0.01 | 0.001 | 0.03 | 0.005 | 0.0060 | 0.110 | 0.095 | Mg: 0.0008 | 808 | Inventive steel |
| H | 0.33 | 0.8 | 1.3 | 0.02 | 0.003 | 0.04 | 0.002 | 0.0080 | 0.048 | 0.124 | REM: 0.0015 | 836 | Inventive steel |
| I | 0.13 | 1.1 | 2.3 | 0.03 | 0.001 | 0.04 | 0.004 | 0.0040 | 0.060 | 0.036 | | 878 | Comparative steel |
| J | 0.57 | 0.3 | 1.5 | 0.02 | 0.001 | 0.05 | 0.006 | 0.0090 | 0.034 | 0.054 | | 757 | Comparative steel |
| K | 0.30 | 2.1 | 1.8 | 0.01 | 0.002 | 0.03 | 0.005 | 0.0120 | 0.055 | 0.068 | | 904 | Comparative steel |
| L | 0.35 | 0.9 | 0.4 | 0.03 | 0.003 | 0.05 | 0.004 | 0.0060 | 0.046 | 0.043 | | 851 | Comparative steel |
| M | 0.27 | 0.5 | 2.8 | 0.02 | 0.002 | 0.04 | 0.003 | 0.0130 | 0.087 | 0.034 | | 810 | Comparative steel |
| N | 0.38 | 1.0 | 1.3 | 0.09 | 0.003 | 0.04 | 0.004 | 0.0070 | 0.068 | 0.024 | | 836 | Comparative steel |
| O | 0.31 | 0.6 | 1.9 | 0.02 | 0.013 | 0.03 | 0.005 | 0.0080 | 0.090 | 0.022 | | 820 | Comparative steel |
| P | 0.34 | 0.8 | 1.7 | 0.01 | 0.001 | 0.02 | 0.033 | 0.0100 | 0.050 | 0.087 | | 828 | Comparative steel |
| Q | 0.27 | 0.5 | 2.2 | 0.03 | 0.001 | 0.06 | 0.004 | 0.0004 | 0.051 | 0.039 | | 819 | Comparative steel |
| R | 0.30 | 0.7 | 1.4 | 0.04 | 0.002 | 0.04 | 0.003 | 0.0040 | 0.002 | 0.034 | | 835 | Comparative steel |
| S | 0.39 | 1.2 | 2.0 | 0.01 | 0.001 | 0.03 | 0.002 | 0.0070 | 0.024 | 0.003 | | 834 | Comparative steel |

TABLE 2

| No. | Steel type | Slab heating temp. [° C.] | Slab heating time [min] | Finish rolling temp. [° C.] | Coiling temp. [° C.] | Pickling: Acid liquid temp. [° C.] | Pickling: Pickling time [s] | 1st annealing: Soaking temp. [° C.] | 1st annealing: Retaining time at soaking temp. [s] | 1st annealing: Cooling stop temp. [° C.] |
|---|---|---|---|---|---|---|---|---|---|---|
| 1 | A | 1130 | 70 | 890 | 420 | 30 | 80 | 920 | 150 | 370 |
| 2 | A | 1130 | 70 | 890 | 420 | 30 | 10 | 920 | 150 | 370 |
| 3 | B | 1170 | 60 | 930 | 470 | 25 | 55 | 870 | 200 | 440 |
| 4 | C | 1110 | 70 | 900 | 430 | 35 | 90 | 860 | 350 | 400 |
| 5 | D | 1200 | 50 | 860 | 460 | 25 | 40 | 900 | 180 | 430 |
| 6 | E | 1160 | 80 | 890 | 420 | 50 | 25 | 910 | 240 | 380 |
| 7 | F | 1230 | 60 | 920 | 480 | 35 | 35 | 930 | 300 | 390 |
| 8 | G | 1120 | 50 | 920 | 410 | 20 | 95 | 900 | 480 | 360 |
| 9 | H | 1170 | 100 | 880 | 440 | 25 | 60 | 890 | 550 | 420 |
| 10 | I | 1150 | 50 | 900 | 440 | 35 | 65 | 920 | 420 | 400 |
| 11 | J | 1210 | 80 | 870 | 480 | 40 | 75 | 860 | 120 | 410 |
| 12 | K | 1200 | 70 | 910 | 430 | 45 | 50 | 900 | 90 | 440 |
| 13 | L | 1130 | 110 | 940 | 400 | 35 | 35 | 910 | 270 | 370 |
| 14 | M | 1190 | 40 | 920 | 480 | 20 | 70 | 940 | 540 | 390 |
| 15 | N | 1170 | 50 | 880 | 430 | 30 | 60 | 920 | 250 | 410 |
| 16 | O | 1220 | 80 | 900 | 450 | 55 | 45 | 880 | 170 | 440 |
| 17 | P | 1150 | 60 | 920 | 470 | 20 | 80 | 900 | 360 | 430 |
| 18 | Q | 1180 | 90 | 870 | 400 | 25 | 25 | 930 | 80 | 390 |
| 19 | R | 1140 | 60 | 910 | 390 | 30 | 35 | 910 | 500 | 370 |
| 20 | S | 1210 | 60 | 930 | 430 | 45 | 70 | 890 | 410 | 400 |

| No. | 1st annealing: Retaining time at cooling stop temp. [s] | 2nd annealing: Soaking temp. [° C.] | 2nd annealing: Retaining time at soaking temp. [s] | 2nd annealing: Average cooling rate [° C./s] | 2nd annealing: Cooling stop temp. [° C.] | Plating treatment Plating type | Hot pressing: Heating start temp. [° C.] | Hot pressing: Average heating rate from heating start temp. to $Ac_3$ tranformation point [° C./s] | Hot pressing: Heating temp. [° C.] | Remarks |
|---|---|---|---|---|---|---|---|---|---|---|
| 1 | 450 | 840 | 65 | 15 | 550 | Zn | 20 | 55 | 875 | Inventive example |
| 2 | 450 | 840 | 65 | 15 | 550 | Zn | 30 | 65 | 875 | Inventive example |
| 3 | 320 | 820 | 180 | 20 | 420 | Zn | 25 | 50 | 900 | Inventive example |
| 4 | 950 | 750 | 300 | 15 | 450 | Zn—Ni | 15 | 60 | 860 | Inventive example |
| 5 | 1200 | 770 | 90 | 15 | 370 | Al | 5 | 70 | 915 | Inventive example |

TABLE 2-continued

| | | | | | | | | | | |
|---|---|---|---|---|---|---|---|---|---|---|
| 6 | 400 | 800 | 150 | 25 | 500 | Zn | 40 | 100 | 855 | Inventive example |
| 7 | 660 | 830 | 45 | 20 | 490 | Zn—Ni | 50 | 65 | 860 | Inventive example |
| 8 | 240 | 790 | 120 | 10 | 510 | Zn | 25 | 55 | 830 | Inventive example |
| 9 | 1560 | 810 | 65 | 20 | 380 | Zn | 15 | 55 | 895 | Inventive example |
| 10 | 480 | 830 | 350 | 10 | 570 | Al | 35 | 60 | 900 | Comparative example |
| 11 | 130 | 740 | 240 | 5 | 450 | Zn—Ni | 10 | 70 | 850 | Comparative example |
| 12 | 490 | 840 | 35 | 25 | 440 | Zn | 50 | 80 | 910 | Comparative example |
| 13 | 670 | 820 | 120 | 15 | 340 | Zn | 15 | 90 | 875 | Comparative example |
| 14 | 200 | 800 | 90 | 10 | 450 | Zn | 25 | 100 | 880 | Comparative example |
| 15 | 890 | 820 | 45 | 10 | 420 | Zn—Ni | 30 | 85 | 900 | Comparative example |
| 16 | 750 | 810 | 300 | 20 | 520 | Zn—Ni | 20 | 65 | 845 | Comparative example |
| 17 | 310 | 760 | 240 | 25 | 330 | Zn | 25 | 55 | 905 | Comparative example |
| 18 | 960 | 830 | 180 | 20 | 490 | Al | 5 | 60 | 870 | Comparative example |
| 19 | 170 | 820 | 120 | 10 | 520 | Zn | 10 | 70 | 920 | Comparative example |
| 20 | 580 | 840 | 75 | 5 | 360 | Zn—Ni | 20 | 80 | 865 | Comparative example |

TABLE 3

| | | | | | | | | 1st annealing | | |
|---|---|---|---|---|---|---|---|---|---|---|
| | | | | | | Pickling | | | Retaining | |
| No. | Steel type | Slab heating temp. [° C.] | Slab heating time [min] | Finish rolling temp. [° C.] | Coiling temp. [° C.] | Acid liquid temp. [° C.] | Pickling time [s] | Soaking temp. [° C.] | time at soaking temp. [s] | Cooling stop temp. [° C.] |
| 21 | A | 1300 | 70 | 910 | 480 | 30 | 65 | 900 | 330 | 370 |
| 22 | A | 1200 | 160 | 880 | 430 | 25 | 95 | 880 | 460 | 410 |
| 23 | A | 1120 | 60 | 820 | 380 | 35 | 50 | 900 | 320 | 400 |
| 24 | A | 1180 | 80 | 990 | 430 | 45 | 40 | 860 | 250 | 360 |
| 25 | B | 1130 | 90 | 870 | 620 | 20 | 45 | 930 | 130 | 390 |
| 26 | B | 1220 | 50 | 940 | 490 | 10 | 50 | 890 | 510 | 410 |
| 27 | B | 1200 | 70 | 910 | 450 | 50 | 5 | 900 | 150 | 440 |
| 28 | B | 1180 | 80 | 910 | 390 | 40 | 75 | 810 | 350 | 370 |
| 29 | A | 1210 | 80 | 860 | 410 | 35 | 30 | 990 | 270 | 420 |
| 30 | A | 1150 | 90 | 890 | 440 | 20 | 35 | 870 | 740 | 430 |
| 31 | A | 1220 | 40 | 900 | 480 | 55 | 50 | 900 | 400 | 260 |
| 32 | A | 1170 | 100 | 870 | 430 | 25 | 65 | 930 | 260 | 490 |
| 33 | A | 1150 | 60 | 930 | 490 | 35 | 80 | 940 | 80 | 430 |
| 34 | B | 1190 | 50 | 910 | 410 | 30 | 80 | 900 | 120 | 400 |
| 35 | B | 1230 | 80 | 880 | 410 | 25 | 45 | 880 | 270 | 370 |
| 36 | B | 1110 | 90 | 900 | 480 | 35 | 90 | 860 | 320 | 420 |
| 37 | B | 1170 | 100 | 870 | 450 | 40 | 75 | 880 | 110 | 430 |
| 38 | B | 1200 | 80 | 860 | 390 | 40 | 60 | 890 | 190 | 380 |
| 39 | A | 1210 | 90 | 920 | 470 | 35 | 50 | 900 | 460 | 360 |
| 40 | A | 1120 | 60 | 930 | 420 | 45 | 30 | 870 | 370 | 400 |
| 41 | A | 1150 | 70 | 900 | 450 | 50 | 40 | 900 | 400 | 400 |
| 42 | A | 1150 | 70 | 900 | 450 | 50 | 40 | 900 | 400 | 400 |

TABLE 3-continued

| No. | 1st annealing: Retaining time at cooling stop temp. [s] | 2nd annealing: Soaking temp. [° C.] | 2nd annealing: Retaining time at soaking temp. [s] | 2nd annealing: Average cooling rate [° C./s] | 2nd annealing: Cooling stop temp. [° C.] | Plating treatment Plating type | Hot pressing: Heating start temp. [° C.] | Hot pressing: Average heating rate from heating start temp. to $Ac_3$ tranformation point [° C./s] | Hot pressing: Heating temp. [° C.] | Remarks |
|---|---|---|---|---|---|---|---|---|---|---|
| 21 | 1740 | 820 | 60 | 15 | 490 | Zn | 25 | 65 | 870 | Comparative example |
| 22 | 480 | 830 | 350 | 10 | 430 | Zn | 35 | 55 | 880 | Comparative example |
| 23 | 600 | 840 | 25 | 20 | 490 | Zn | 55 | 70 | 910 | Comparative example |
| 24 | 720 | 800 | 80 | 15 | 520 | Zn—Ni | 50 | 80 | 875 | Comparative example |
| 25 | 240 | 780 | 240 | 15 | 380 | Al | 40 | 90 | 930 | Comparative example |
| 26 | 900 | 790 | 45 | 5 | 410 | Zn | 20 | 75 | 905 | Comparative example |
| 27 | 1200 | 780 | 180 | 20 | 520 | Zn | 10 | 55 | 870 | Comparative example |
| 28 | 240 | 750 | 150 | 20 | 530 | Zn | 5 | 60 | 865 | Comparative example |
| 29 | 120 | 790 | 75 | 20 | 470 | Zn—Ni | 30 | 80 | 900 | Comparative example |
| 30 | 580 | 820 | 100 | 15 | 500 | Zn | 50 | 70 | 890 | Comparative example |
| 31 | 720 | 810 | 65 | 10 | 370 | Zn | 35 | 60 | 875 | Comparative example |
| 32 | 180 | 830 | 80 | 10 | 450 | Al | 15 | 55 | 900 | Comparative example |
| 33 | 15 | 840 | 360 | 15 | 520 | Zn—Ni | 10 | 65 | 860 | Comparative example |
| 34 | 960 | 650 | 30 | 25 | 420 | Zn | 40 | 70 | 885 | Comparative example |
| 35 | 480 | 910 | 60 | 10 | 450 | Zn | 50 | 85 | 925 | Comparative example |
| 36 | 300 | 770 | 7 | 10 | 330 | Zn—Ni | 20 | 90 | 900 | Comparative example |
| 37 | 450 | 820 | 300 | 2 | 500 | Al | 10 | 100 | 880 | Comparative example |
| 38 | 950 | 810 | 60 | 15 | 650 | Zn | 15 | 55 | 915 | Comparative example |
| 39 | 660 | 790 | 180 | 20 | 360 | Zn | 20 | 65 | 780 | Comparative example |
| 40 | 120 | 820 | 95 | 15 | 550 | Zn | 10 | 60 | 950 | Comparative example |
| 41 | 500 | 780 | 200 | 25 | 500 | Zn | 25 | 60 | 870 | Inventive example |
| 42 | 500 | 780 | 200 | 25 | 500 | Zn | 25 | 40 | 870 | Inventive example |

TABLE 4

| No. | Steel type | Microstructure: Average grain size of prior austenite [μm] | Microstructure: Volume fraction of martensite [%] | Thickness of oxide layer on surface of plating layer [μm] | Ten point height of irregularities Rzjis [μm] | Tesnsile strength TS [MPa] | Indentation peeling strength | Remarks |
|---|---|---|---|---|---|---|---|---|
| 1 | A | 5 | 96 | 4 | 9.4 | 1834 | A | Inventive example |
| 2 | A | 5 | 96 | 3 | 17.0 | 1834 | B | Inventive example |
| 3 | B | 4 | 100 | 5 | 14.5 | 1863 | A | Inventive example |
| 4 | C | 4 | 92 | 3 | 11.2 | 2185 | A | Inventive example |
| 5 | D | 5 | 92 | 4 | 8.7 | 1954 | A | Inventive example |

TABLE 4-continued

| No. | Steel type | Microstructure: Average grain size of prior austenite [μm] | Microstructure: Volume fraction of martensite [%] | Thickness of oxide layer on surface of plating layer [μm] | Ten point height of irregularities Rzjis [μm] | Tesnsile strength TS [MPa] | Indentation peeling strength | Remarks |
|---|---|---|---|---|---|---|---|---|
| 6 | E | 6 | 94 | 1 | 16.8 | 1843 | B | Inventive example |
| 7 | F | 5 | 97 | 3 | 8.9 | 1812 | A | Inventive example |
| 8 | G | 3 | 99 | 4 | 10.4 | 1925 | A | Inventive example |
| 9 | H | 4 | 95 | 4 | 13.0 | 1904 | A | Inventive example |
| 10 | I | 5 | 99 | 5 | 19.7 | 1260 | B | Comparative example |
| 11 | J | 5 | 95 | 4 | 12.7 | 2529 | C | Comparative example |
| 12 | K | 4 | 96 | 3 | 28.8 | 2008 | C | Comparative example |
| 13 | L | 3 | 79 | 3 | 11.4 | 1694 | A | Comparative example |
| 14 | M | 4 | 96 | 1 | 9.9 | 1980 | C | Comparative example |
| 15 | N | 4 | 97 | 3 | 13.5 | 1987 | C | Comparative example |
| 16 | O | 5 | 95 | 2 | 16.7 | 1863 | C | Comparative example |
| 17 | P | 6 | 97 | 3 | 12.9 | 1975 | C | Comparative example |
| 18 | R | 4 | 82 | 4 | 13.5 | 1710 | A | Comparative example |
| 19 | R | 9 | 95 | 3 | 10.4 | 1918 | C | Comparative example |
| 20 | S | 10 | 96 | 2 | 8.7 | 2085 | C | Comparative example |

TABLE 5

| No. | Steel type | Microstructure: Average grain size of prior austenite [μm] | Microstructure: Volume fraction of martensite [%] | Thickness of oxide layer on surface of plating layer [μm] | Ten point height of irregularities Rzjis [μm] | Tesnsile strength TS [MPa] | Indentation peeling strength | Remarks |
|---|---|---|---|---|---|---|---|---|
| 21 | A | 4 | 93 | 4 | 30.1 | 1825 | C | Comparative example |
| 22 | A | 6 | 94 | 5 | 27.4 | 1845 | C | Comparative example |
| 23 | A | 5 | 76 | 3 | 18.0 | 1722 | B | Comparative example |
| 24 | A | 9 | 98 | 2 | 15.1 | 1823 | C | Comparative example |
| 25 | B | 6 | 85 | 2 | 13.8 | 1740 | A | Comparative example |
| 26 | B | 5 | 95 | 3 | 29.0 | 1879 | C | Comparative example |
| 27 | B | 5 | 98 | 5 | 31.5 | 1850 | C | Comparative example |
| 28 | B | 8 | 96 | 5 | 11.6 | 1789 | C | Comparative example |
| 29 | A | 10 | 98 | 3 | 14.1 | 1828 | C | Comparative example |
| 30 | A | 10 | 97 | 4 | 16.0 | 1835 | C | Comparative example |
| 31 | A | 12 | 92 | 4 | 9.9 | 1809 | C | Comparative example |
| 32 | A | 9 | 95 | 5 | 13.3 | 1850 | C | Comparative example |
| 33 | A | 8 | 99 | 4 | 10.7 | 1862 | C | Comparative example |
| 34 | B | 4 | 69 | 3 | 20.8 | 1422 | B | Comparative example |

TABLE 5-continued

| No. | Steel type | Microstructure: Average grain size of prior austenite [μm] | Microstructure: Volume fraction of martensite [%] | Thickness of oxide layer on surface of plating layer [μm] | Ten point height of irregularities Rzjis [μm] | Tesnsile strength TS [MPa] | Indentation peeling strength | Remarks |
|---|---|---|---|---|---|---|---|---|
| 35 | B | 12 | 100 | 3 | 15.5 | 2107 | C | Comparative example |
| 36 | B | 3 | 80 | 2 | 16.2 | 1703 | B | Comparative example |
| 37 | B | 6 | 86 | 1 | 18.9 | 1720 | C | Comparative example |
| 38 | B | 6 | 87 | 5 | 10.3 | 1642 | A | Comparative example |
| 39 | A | 5 | 78 | 3 | 12.5 | 1580 | A | Comparative example |
| 40 | A | 5 | 93 | 3 | 29.4 | 1975 | C | Comparative example |
| 41 | A | 5 | 94 | 4 | 14.5 | 1855 | A | Inventive example |
| 42 | A | 6 | 96 | 6 | 16.5 | 1865 | B | Inventive example |

In Tables 1 to 5 above, the underlined figures are those outside of the range of the invention or those outside of the preferred range.

In the column of "2nd annealing" in the Tables 2 and 3 above, "Average cooling rate" shows an average cooling rate from "soaking temperature" to "cooling stop temperature."

Summary of Evaluation Results

The hot pressed members of Nos. 1 to 9, 41 and 42 had tensile strength of not less than 1,780 MPa and, besides, excellent indentation peeling strength.

Comparing Nos. 1 and 2 sharing the same conditions except the pickling time, the value of ten point height of irregularities was smaller as well as the indentation peeling strength was better in No. 1 where the pickling time was long than in No. 2 where the pickling time was short.

Comparing Nos. 41 and 42 sharing the same conditions except the average heating rate from the heating start temperature to the $Ac_3$ transformation point, the oxide layer on a surface of the plating layer was thinner as well as the indentation peeling strength was better in No. 41 where the average heating rate was high than in No. 42 where the average heating rate was low.

On the other hand, No. 10 (using Steel type I with a small amount of C) had tensile strength of less than 1,780 MPa.

No. 11 (using Steel type J with a large amount of C) had insufficient indentation peeling strength.

No. 12 (using Steel type K with a large amount of Si) had a large value of ten point height of irregularities and insufficient indentation peeling strength.

No. 13 (using Steel type L with a small amount of Mn) had a small volume fraction of martensite and tensile strength of less than 1,780 MPa.

No. 14 (using Steel type M with a large amount of Mn) had insufficient indentation peeling strength.

No. 15 (using Steel type N with a large amount of P) had insufficient indentation peeling strength.

No. 16 (using Steel type 0 with a large amount of S) had insufficient indentation peeling strength.

No. 17 (using Steel type P with a large amount of N) had insufficient indentation peeling strength.

No. 18 (using Steel type Q with a small amount of Sb) had a small volume fraction of martensite and tensile strength of less than 1,780 MPa.

No. 19 (using Steel type R with a small amount of Nb) had a large average grain size of prior austenite and insufficient indentation peeling strength.

No. 20 (using Steel type S with a small amount of Ti) had a large average grain size of prior austenite and insufficient indentation peeling strength.

No. 21 (with high slab heating temperature) had a large value of ten point height of irregularities and insufficient indentation peeling strength.

No. 22 (with long slab heating time) had a large value of ten point height of irregularities and insufficient indentation peeling strength.

No. 23 (with low finish rolling temperature) had a small volume fraction of martensite and tensile strength of less than 1,780 MPa.

No. 24 (with high finish rolling temperature) had a large average grain size of prior austenite and insufficient indentation peeling strength.

No. 25 (with high coiling temperature) had a small volume fraction of martensite and tensile strength of less than 1,780 MPa.

No. 26 (with low acid liquid temperature) had a large value of ten point height of irregularities and insufficient indentation peeling strength.

No. 27 (with short pickling time) had a large value of ten point height of irregularities and insufficient indentation peeling strength.

No. 28 (with low soaking temperature of the first annealing) had a large average grain size of prior austenite and insufficient indentation peeling strength.

No. 29 (with high soaking temperature of the first annealing) had a large average grain size of prior austenite and insufficient indentation peeling strength.

No. 30 (with long retaining time at soaking temperature of the first annealing) had a large average grain size of prior austenite and insufficient indentation peeling strength.

No. 31 (with low cooling stop temperature of the first annealing) had a large average grain size of prior austenite and insufficient indentation peeling strength.

No. 32 (with high cooling stop temperature of the first annealing) had a large average grain size of prior austenite and insufficient indentation peeling strength.

No. 33 (with short retaining time at cooling stop temperature of the first annealing) had a large average grain size of prior austenite and insufficient indentation peeling strength.

No. 34 (with low soaking temperature of the second annealing) had a small volume fraction of martensite and tensile strength of less than 1,780 MPa.

No. 35 (with high soaking temperature of the second annealing) had a large average grain size of prior austenite and insufficient indentation peeling strength.

No. 36 (with short retaining time at soaking temperature of the second annealing) had a small volume fraction of martensite and tensile strength of less than 1,780 MPa.

No. 37 (with low average cooling rate of the second annealing) had a small volume fraction of martensite and tensile strength of less than 1,780 MPa.

No. 38 (with high cooling stop temperature of the second annealing) had a small volume fraction of martensite and tensile strength of less than 1,780 MPa.

No. 39 (with low heating temperature in hot pressing) had a small volume fraction of martensite and tensile strength of less than 1,780 MPa.

No. 40 (with high heating temperature in hot pressing) had a large value of ten point height of irregularities and insufficient indentation peeling strength.

The invention claimed is:

1. A hot pressed member including a steel sheet and a plating layer on a surface of the steel sheet, wherein the hot pressed member has a tensile strength of not less than 1,780 MPa, wherein ten point height of irregularities Rzjis of a surface of the plating layer is not more than 15.0 μm, and wherein the steel sheet has a chemical composition containing, by mass %, C: not less than 0.25% and less than 0.50%, Si: not more than 1.5%, Mn: not less than 1.1% and not more than 2.4%, P: not more than 0.05%, S: not more than 0.005%, Al: not less than 0.01% and not more than 0.50%, N: not more than 0.010%, Sb: not less than 0.001% and not more than 0.020%, Nb: not less than 0.005% and not more than 0.15%, and Ti: not less than 0.005% and not more than 0.15%, with the balance being Fe and inevitable impurities, and wherein the steel sheet has, in a region within 50 μm in a sheet thickness direction from a surface of the steel sheet excluding the plating layer, a microstructure in which prior austenite has an average grain size of not more than 7 μm, and a volume fraction of martensite is not less than 90%.

2. The hot pressed member according to claim 1, wherein the chemical composition of the steel sheet further contains at least one selected from the group consisting of, by mass %, B: not less than 0.0002% and not more than 0.0050%, Mo: not less than 0.005% and not more than 0.50%, Cr: not less than 0.005% and not more than 0.50%, Ca: not less than 0.0002% and not more than 0.005%, Mg: not less than 0.0002% and not more than 0.005%, REM: not less than 0.0002% and not more than 0.005%, V: not less than 0.02% and not more than 0.15%, Cu: not less than 0.02% and not more than 0.50%, Ni: not less than 0.02% and not more than 0.50%, Sn: not less than 0.001% and not more than 0.50%, Zn: not less than 0.01% and not more than 0.10%, and Ta: not less than 0.01% and not more than 0.10%.

3. The hot pressed member according to claim 2, wherein the plating layer is a Zn-based plating layer, a Zn—Ni-based plating layer, or an Al-based plating layer.

4. The hot pressed member according to claim 1, wherein the plating layer is a Zn-based plating layer, a Zn—Ni-based plating layer, or an Al-based plating layer.

5. A method of producing a steel sheet for hot pressing, the method comprising:

heating a steel material having the chemical composition described in claim 1 at temperature of not lower than 1,100° C. and not higher than 1,250° C. for not less than 30 minutes and not more than 120 minutes;

hot rolling the steel material having undergone the heating at finish rolling temperature of not lower than 860° C. and not higher than 950° C. to obtain a hot rolled steel sheet;

coiling the hot rolled steel sheet at coiling temperature of not higher than 500° C.;

pickling the hot rolled steel sheet having undergone the coiling using an acid liquid at temperature of not lower than 20° C. and not higher than 70° C. for not less than 10-20 seconds and not more than 100 seconds;

cold rolling the hot rolled steel sheet having undergone the pickling to obtain a cold rolled steel sheet;

subjecting the cold rolled steel sheet to annealing comprising a first annealing and a second annealing; and plating the cold rolled steel sheet having undergone the annealing, whereby the steel sheet for hot pressing is obtained, where in the first annealing, the cold rolled steel sheet is retained at temperature of not lower than 850° C. and not higher than 950° C. for not more than 600 seconds, subsequently cooled to cooling stop temperature of not lower than 350° C. and not higher than 450° C., retained at the cooling stop temperature for not less than 60 seconds and not more than 1,800 seconds, and thereafter cooled to room temperature, and in the second annealing, the cold rolled steel sheet having been subjected to the first annealing is retained at temperature of not lower than 720° C. and not higher than 850° C. for not less than 15 seconds, and subsequently cooled to cooling stop temperature of not higher than 600° C. at an average cooling rate of not lower than 5° C./s.

6. A method of producing a hot pressed member, the method comprising:

heating a steel sheet for hot pressing obtained by the method of producing a steel sheet for hot pressing according to claim 4 to heating temperature not lower than Ac3 transformation point and not higher than (Ac3+100)° C.; and hot pressing the steel sheet for hot pressing having undergone the heating, whereby the hot pressed member is obtained.

7. The method of producing a hot pressed member according to claim 6, wherein, when the steel sheet for hot pressing is heated to the heating temperature, an average heating rate from heating start temperature to the Ac3 transformation point is not lower than 50° C./s.

8. A method of producing a steel sheet for hot pressing, the method comprising:

heating a steel material having the chemical composition described in claim 2 at temperature of not lower than 1,100° C. and not higher than 1,250° C. for not less than 30 minutes and not more than 120 minutes;

hot rolling the steel material having undergone the heating at finish rolling temperature of not lower than 860° C. and not higher than 950° C. to obtain a hot rolled steel sheet;

coiling the hot rolled steel sheet at coiling temperature of not higher than 500° C.;

pickling the hot rolled steel sheet having undergone the coiling using an acid liquid at temperature of not lower than 20° C. and not higher than 70° C. for not less than 10 seconds and not more than 100 seconds;

cold rolling the hot rolled steel sheet having undergone the pickling to obtain a cold rolled steel sheet;

subjecting the cold rolled steel sheet to annealing comprising a first annealing and a second annealing; and plating the cold rolled steel sheet having undergone the annealing, whereby the steel sheet for hot pressing is obtained, where in the first annealing, the cold rolled steel sheet is retained at temperature of not lower than 850° C. and not higher than 950° C. for not more than 600 seconds, subsequently cooled to cooling stop temperature of not lower than 350° C. and not higher than 450° C., retained at the cooling stop temperature for not less than 60 seconds and not more than 1,800 seconds, and thereafter cooled to room temperature, and in the second annealing, the cold rolled steel sheet having been subjected to the first annealing is retained at temperature of not lower than 720° C. and not higher than 850° C. for not less than 15 seconds, and subsequently cooled to cooling stop temperature of not higher than 600° C. at an average cooling rate of not lower than 5° C./s.

9. A method of producing a hot pressed member, the method comprising:

heating a steel sheet for hot pressing obtained by the method of producing a steel sheet for hot pressing according to claim 8 to heating temperature not lower than Ac3 transformation point and not higher than (Ac3+100)° C.; and hot pressing the steel sheet for hot pressing having undergone the heating, whereby the hot pressed member is obtained.

10. The method of producing a hot pressed member according to claim 9, wherein, when the steel sheet for hot pressing is heated to the heating temperature, an average heating rate from heating start temperature to the Ac3 transformation point is not lower than 50° C./s.

* * * * *